United States Patent [19]

Morris et al.

[11] Patent Number: 4,462,123

[45] Date of Patent: Jul. 31, 1984

[54] FABRICATED FLOOR DRAIN WITH LARGE STEPPED FLANGE FOR ELASTOMERIC TROWELLED COVERING

[75] Inventors: Earl L. Morris, La Habra Heights; V. Walter Hafner, Whittier, both of Calif.

[73] Assignee: Acorn Engineering Company, City of Industry, Calif.

[21] Appl. No.: 428,404

[22] Filed: Sep. 29, 1982

[51] Int. Cl.[3] ..... E03C 1/26

[52] U.S. Cl. ..... 4/286; 52/126.2; 52/364

[58] Field of Search ..... 52/364–367, 52/126.2; 4/286–295, 613; 220/3.2–3.5; 285/42, 56

[56] References Cited

U.S. PATENT DOCUMENTS

| | | | |
|---|---|---|---|
| 3,394,509 | 7/1968 | McKinley | 220/3.4 |
| 4,198,717 | 4/1980 | Kessel | 4/286 |
| 4,321,713 | 3/1982 | Thompson | 4/290 |

*Primary Examiner*—Stephen Marcus

*Attorney, Agent, or Firm*—Edgar W. Averill, Jr.

[57] ABSTRACT

A fabricated floor drain for waste reception. The drain has a receptor body having a bottom outlet and generally vertical side walls. A top rim is affixed to the top of the body and a large top flange having a removable screed guide is affixed to the top rim.

10 Claims, 4 Drawing Figures

FABRICATED FLOOR DRAIN WITH LARGE STEPPED FLANGE FOR ELASTOMERIC TROWELLED COVERING

BACKGROUND OF THE INVENTION

The field of the invention is waste drains and the invention relates more particularly to drains of the type useful in floors where the surface of the floor is covered with an elastomeric covering.

In many waste outlet installations it is necessary that the floor in which the outlet is installed be coated with an elastomeric coating. Such elastomeric compositions can provide a durable floor which is seamless and resistant to spillage of great amounts of water as well as a wide range of chemicals. Shower rooms, mental institutions, drunk tanks, locker rooms, food processing plants, and the like are typical environments where such coatings are useful. In many such installations floor drains and more particularly floor sinks or receptors are utilized to accept fluids which have been washed from the floor to conduct the same into the drainage system. In many installations it is particularly important that there be a complete conveyance of liquids from the floor to the drain without any seepage of the waste products around the outside of the drain where they can lead to bacterial growth, undesirable odors or other hazardous conditions.

Although elastomeric coatings are very effective in providing a complete seal over large concrete surfaces, a problem area is the intersection of the floor covering with the waste drain. Typically such elastomeric coatings are trowelled over the intersection of the floor and the drain and such intersections provide a possible source of seepage and a better method is needed to integrate the floor surface with the drain.

A typical installation of a waste drain in an elastomeric covered concrete floor is shown on the second page of a product description sheet entitled Kwik-Floor. A waste drain having a large top flange is installed so that the edge of the flange is even with the top of the concrete. This intersection is covered with a slip sheet, membrane and trowelled elastomeric coating. The intersection of the flange and the concrete provides a source of a crack in the elastomeric coating and a thicker elastomeric coating would be desirable. Another method commonly used is to use the rim of the drain as a screed guide and then to chip away the thin layer of cement above the flange. This, of course, increases the labor cost and can also lead to damage to the flange.

SUMMARY OF THE INVENTION

It is an object of the present invention to provide a floor drain which may be installed in an elastomeric covered floor in a manner which reduces the possibility of leakage around the exterior of the drain.

The present invention is for a fabricated floor drain for waste reception comprising a receptor body having a bottom outlet and generally vertical side walls. A top rim is affixed to the top of the receptor body and a large top flange is affixed to the top rim. The top flange has a generally planar surface and a removable screed guide is affixed to the upper surface of the large top flange near the outer edge thereof. Preferably these screed guides comprises at least one length of a flexible tape which has a delayed tack adhesive on the underside thereof which facilitates its removal from the top flange. A tape having a thickness of about $\frac{1}{8}$th of an inch and a width of about one inch is particularly useful.

DESCRIPTION OF THE PREFERRED EMBODIMENTS

Figure 1:
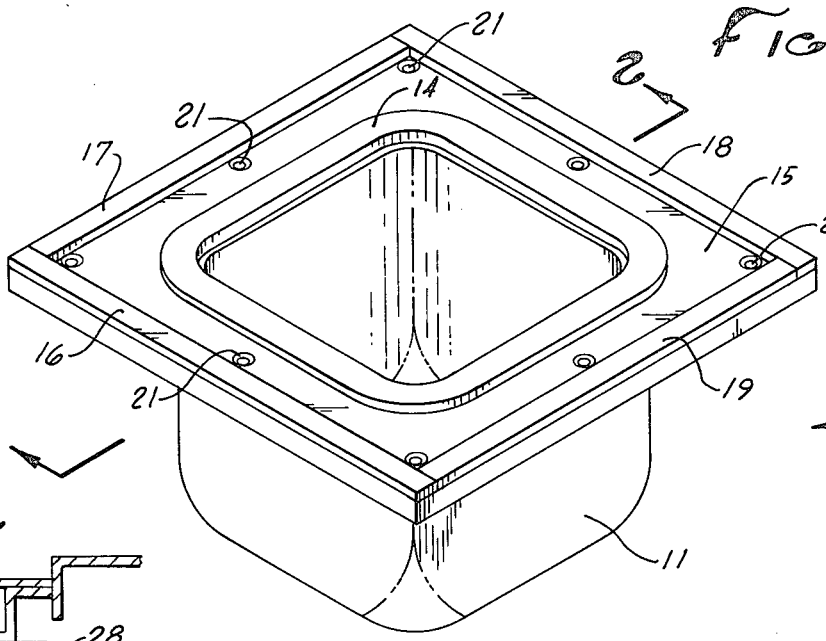
FIG. 1 is a top perspective view of the floor drain of the present invention.

A fabricated drain is shown in perspective view in FIG. 1 and indicated generally by reference 10. The term "fabricated" is intended to mean a drain which has been made by processes such as deep drawing, welding and the like rather than being cast. Such drains are typically deep drawn from corrosion resistant materials such as stainless steel and the interior surfaces of such drains may be polished and rounded so that there are no cracks or other areas for the trapping of bacteria.

Drain 10 has a receptor body 11 which provides a collection point for waste liquids and which is typically covered by a grate, not shown. Receptor body 11 has four generally vertical sides, rounded bottom corners and a bottom outlet 12 which is sealingly attached to the drain pipe, also not shown.

Receptor body 11 terminates at its upper end with a top rim 13 which has a flat upper surface 14. A generally flat or planar flange 15 is welded to the outer edge of top rim 13. Four elastomeric tapes 16 through 19 are adhered to the outer edge of flange 15 and these elastomeric tapes serve as screed guides in a manner described more fully below.

Figure 4:
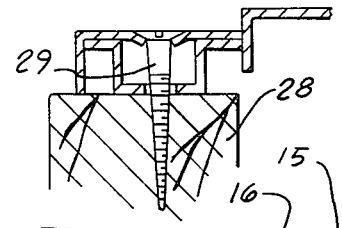
FIG. 4 is an enlarged cross-sectional view of an alternator hold-down configuration of the drain of FIG. 1.
Figure 2:
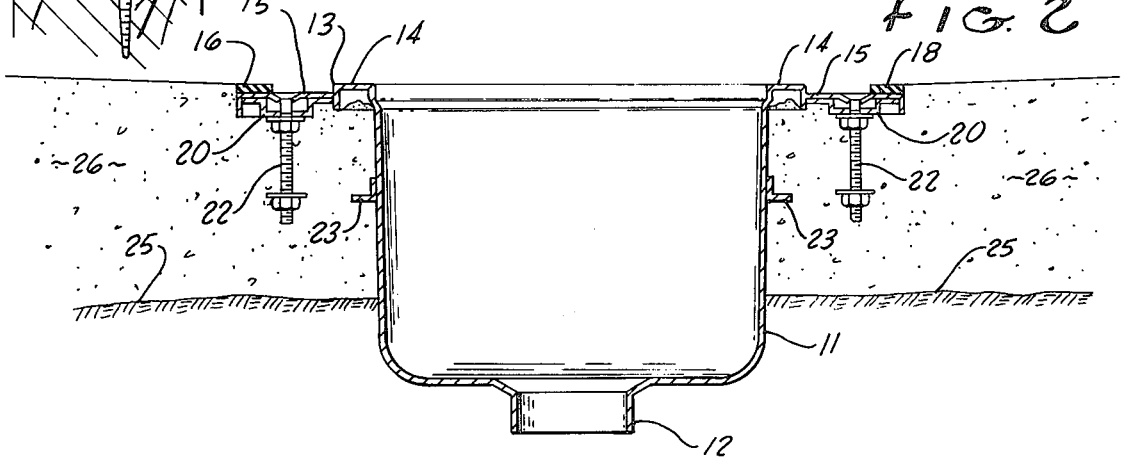
FIG. 2 is a cross sectional side elevation of the drain of FIG. 1 installed in a concrete floor with the screed guide in place.

Reinforcing channels 20 are welded to the under surface of flange 15 to strengthen the flange and to provide a flat bearing surface when the drain is installed on wooden joints. A plurality of holes 21 permit insertion of anchor bolts 22 which may be used to further secure the drain in concrete. Anchor clips 23 further secure the assembly in the concrete and help prevent the drain from rising above the level of concrete or dropping below this level. The holes are preferably spaced 16 inches apart to facilitate attaching the drain to wooden joints when this type of construction is used. FIG. 4 shows attachment of the drain of the present invention to a wooden joist. It can be seen that the reinforcing channel 20 rests securely on joist 28 and is secured thereto by screw 29.

The initial installation of the drain 10 in a concrete floor is conventional and the base of the receptor body rests in the ground 25. Concrete 26 is poured to the top of the elastomeric tapes 16 through 19 which is also in about the same plane as flat surface 14. Tapes 16 through 19 function as screed guides to facilitate the proper level of cement to match the top of the tapes.

Figure 3:
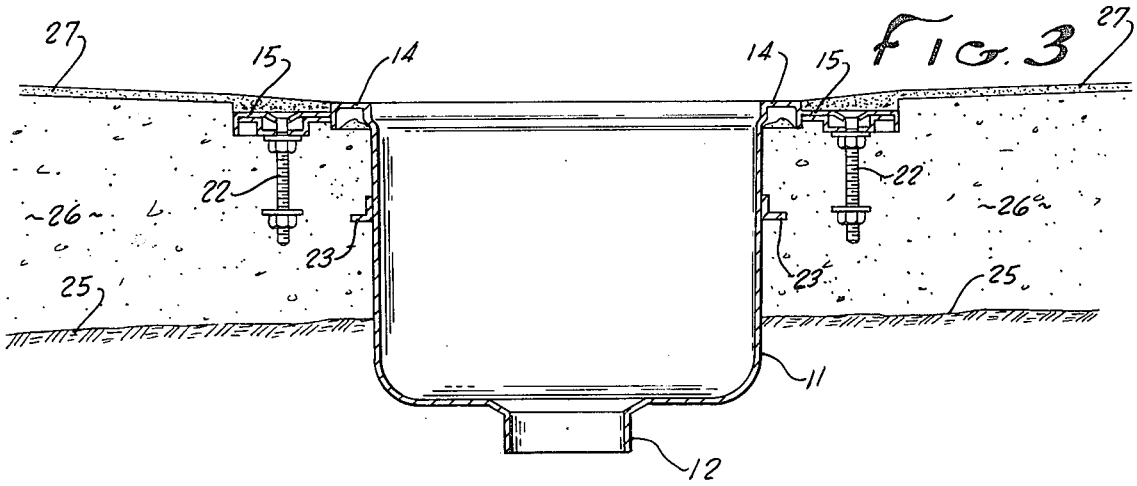
FIG. 3 is a cross-sectional view similar to FIG. 2 with the screed guide removed and an elastomeric coating installed.

After the concrete has cured, elastomeric tapes 16 through 19 are peeled away from flange 15 and an elastomeric coating 27 is applied as shown in FIG. 3 to the outer edge of of the top rim 13. It can be seen that the joint between the outer edge of flange 15 and the concrete is well covered with elastomeric coating and the possibility of leakage at this point is very remote. It can also be seen that rim 14 serves as a finishing edge at the interior of the coating. Preferably the upper surface of flange 15 is sand blasted to a rough finish to further assist the adherence of coating 27 to the flange.

The thickness of the elastomeric tape should be such that its upper surface is about equal to the flat surface 14 of the rim of the receptor body. In this way when the elastomeric coating is slopped downwardly toward the drain the intersection between the edge of the flange and the concrete is well covered. Preferably the elastomeric tape is held to the flange by a delayed tack adhesive so that it may be readily placed on and later removed from the upper surface of the flange. It has been found that elastomeric tapes having thickness of about $\frac{1}{8}$ of an inch and a width of about one inch have been particularly useful in the practice of the present invention. While the drain shown in the drawings has a rectangular flange, the screed guide of the present invention could alternatively be used in a floor drain having a round or other flange. It is important that the flange which surrounds the drain be sufficiently large so that the elastomeric coating can form a complete seal thereto. A typical width of such flange is about two and a half inches, and this width has been found particularly useful to form a very effective and water-tight seal. The particular elastomer which is used for the tape is not critical although it is important that it be sufficiently strong to provide support for the screed and yet be easily removable. Rubber tape has proved satisfactory.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

What is claimed is:

1. A floor drain for waste reception comprising:

a receptor body having a bottom outlet and generally vertical side walls;

a top rim affixed to the top of the receptor body;

a large top flange affixed to the top rim of the receptor body, said top flange having a generally planar surface; and a removable screed guide affixed to the upper surface of the large top flange near the outer edges thereof, said screed guide comprising at least one length of flexible tape with a delayed tack adhesive on the underside thereof to facilitate the removal of the tape from the flange.

2. The floor drain of claim 1 wherein the drain is anchored in concrete by a plurality of anchor screws bolted to the top flange and extending downwardly into the concrete to which it is anchored.

3. The floor drain of claim 1 wherein said flange is rectangular.

4. The floor drain of claim 1 wherein said flange is rectangular and there are four lengths of said elastomeric tape.

5. The floor drain of claim 1 wherein the upper surface of said flange is roughened to increase the adhesion of a floor coating thereto.

6. The floor drain of claim 1 wherein said screed guide is at least one length of elastomeric tape having a thickness of about $\frac{1}{8}$th inch

7. The floor drain of claim 6 wherein said tape is about one inch wide.

8. The floor drain of claim 1 wherein said flange is rectangular and is about two and one half inches wide.

9. The floor drain of claim 1 wherein the screed guide comprises a plurality of lengths of elastomeric tape about $\frac{1}{8}$th inch thick and about one half inch wide removably affixed at the outer edge of said top flange.

10. A floor drain for waste reception comprising:

a receptor body having a bottom outlet and generally vertical side walls;

a top rim affixed to the top of the receptor body;

a large top flange affixed to the top rim of the receptor body, said top flange having a generally planar surface; and a removable screed guide comprising at least one length of elastomeric tape having a thickness of about $\frac{1}{8}$ inch affixed to the upper surface of the large top flange near the outer edges thereof.

* * * * *